United States Patent [19]

Gertsch

[11] Patent Number: 4,467,720

[45] Date of Patent: Aug. 28, 1984

[54] SPIRAL-TYPE DUCTOR

[75] Inventor: Peter Gertsch, Niederscherli, Switzerland

[73] Assignee: Maschinenfabrik Wifag PR, Switzerland

[21] Appl. No.: 438,972

[22] Filed: Nov. 3, 1982

[30] Foreign Application Priority Data

Jun. 11, 1981 [SE] Sweden ..... 8106603

[51] Int. Cl.[3] ..... B41F 31/14; B41L 27/28; B41L 27/16

[52] U.S. Cl. ..... 101/348; 101/DIG. 6

[58] Field of Search ..... 101/348, 349, 350, DIG. 6, 101/148, 205, 206, 207, 208, 209, 351, 352, 353, 356, 358

[56] References Cited

FOREIGN PATENT DOCUMENTS 2903409 8/1979 Fed. Rep. of Germany ... 101/DIG. 6

908692 10/1962 United Kingdom ..... 101/DIG. 6

*Primary Examiner*—J. Reed Fisher

*Attorney, Agent, or Firm*—McGlew and Tuttle

[57] ABSTRACT

Each individual, freely rotatable ring of a spiral-type ductor is mounted on an eccentric which is supported for rotation on a multi-eccentric shaft is angularly offset relative to its adjacent eccentric portion by at least an amount corresponding to the number of rings. The multi-eccentric shaft is connected to the drive of an inking system directly while the eccentric is connected thereto through a pinion, a pinion shaft, a gear and a separate sequential transmission with an integral speed ratio. In consequence, the center of the ring describes a curve which is flattened in the zone where the ring is in contact with an inking roller. The contact duration is thereby extended without varying the speed.

4 Claims, 5 Drawing Figures

19
21
20
18
19
18
22
20

SPIRAL-TYPE DUCTOR

FIELD AND BACKGROUND OF THE INVENTION

The present invention relates in general to inking systems and in particular to a new and useful spiral-type ductor for transferring ink from a fountain roller to a roller for taking up the ink along a spirally extending line using a plurality of eccentrically moving elastic rings.

A spiral-type ductor is known from German AS No. 12 40 889. In that design, all the eccentrics are driven uniformly. The rings which are supported for free rotation on the eccentrics are usually coated with an elastic material which, according to experience and with a full setting against the metal surface of an inking roller, is being radially squeezed to a depth of 0.3 mm. This results in a mutual contact through an angular zone of the eccentric of about 50° to 60°.

Since, of course, an individual ring cannot transfer more than the ink amount taken up from the inking roller during the contact period, very narrow limits are set to the application of this design in practice, since high paper speeds are required entailing a high ink consumption, and neither the thickness of the ink film nor the speed of the inking roller or the degree of setting of the ductor roller can be increased at will without losing control over the entire inking system.

SUMMARY OF THE INVENTION

The present invention is directed to a spiral-type ductor which has a higher inking capacity.

Accordingly, an object of the present invention is to provide a spiral-type ductor for transferring ink from a fountain roller to a roller for taking up ink of an inking system in a rotary printing press comprising a ductor roller which is mounted in a fixed location on the press, which ductor roller is subdivided into a plurality of rings which are mounted for rotation on eccentrics which are provided in angularly offset arrangement on a drivable multi-eccentric shaft, so that the rings come successively and alternately into contact with the fountain roller and the roller for taking up the ink along a strip forming a spiral, each eccentric being mounted for rotation on said multi-eccentric shaft, first drive means connected to each eccentric for rotating each eccentric and second drive means connected to said multi-eccentric shaft for driving said multi-eccentric shaft.

Another object of the invention is to provide such a spiral-type ductor which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Two embodiments of the invention are illustrated in the drawings in which.

DESCRIPTION OF THE PREFERRED EMBODIMENTS

Figure 1:
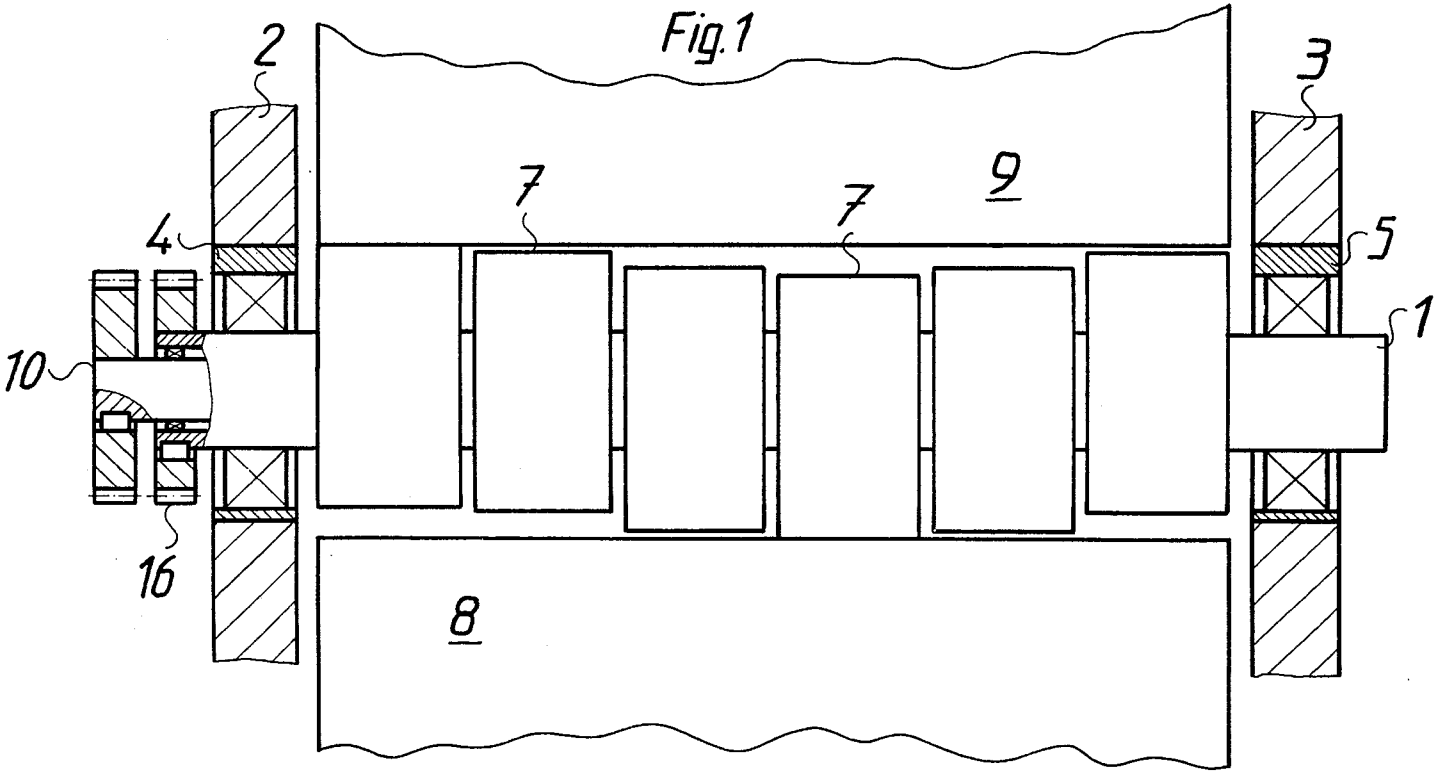
FIG. 1 is a side elevational view of a spiral-type ductor.
Figure 2:
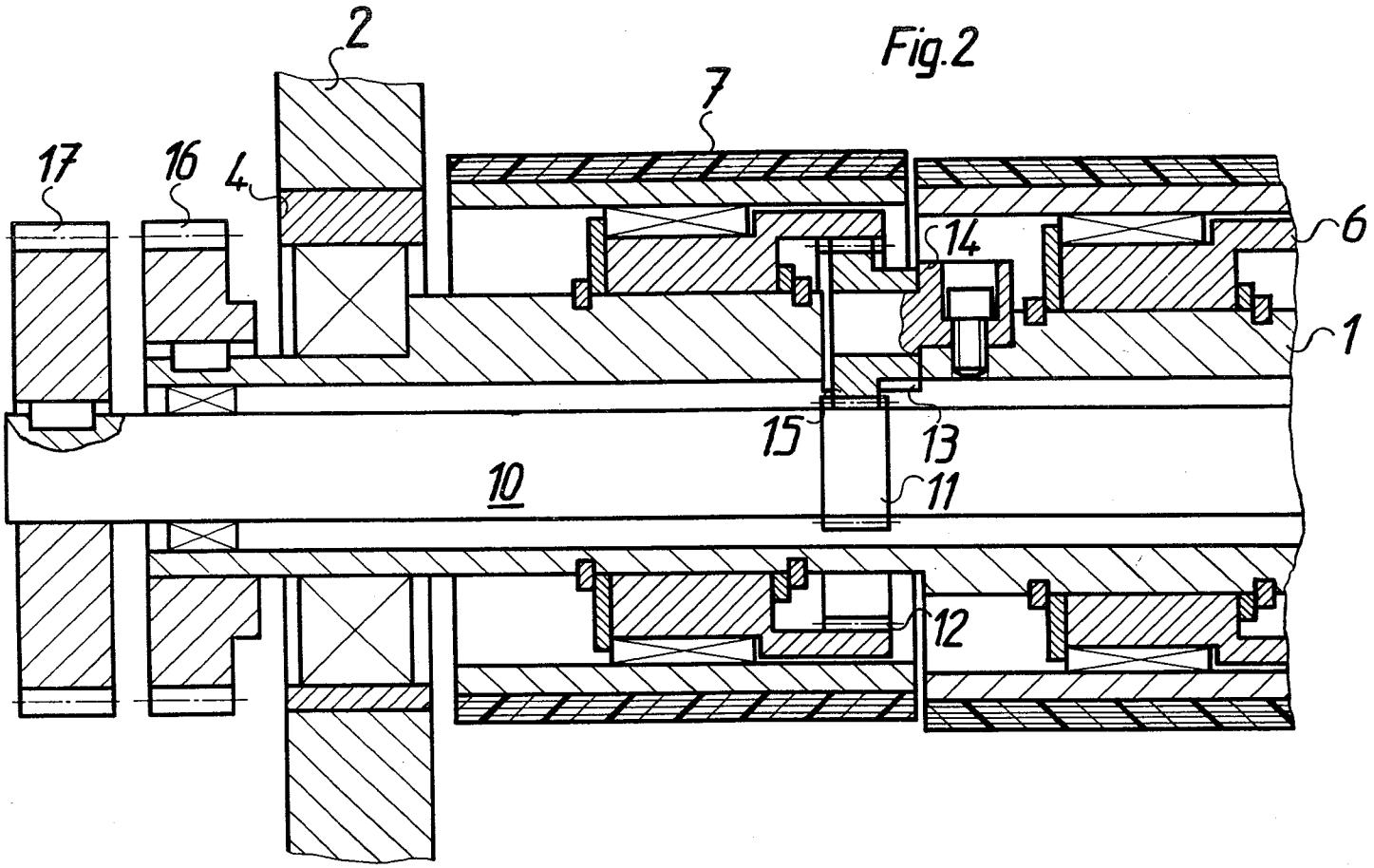
FIG. 2 is a partial sectional view of an embodiment in which the eccentrics are driven through gears.

The spiral-type ductor of the present invention, according to FIG. 1, comprises a multi-eccentric shaft 1 designed as a hollow shaft which is mounted at a fixed location in machine walls 2,3 for rotation in eccentric bushings 4,5 and a plurality of rings 7 which are mounted for rotation on eccentric 6 (FIG. 2). Eccentric bushings 4, 5 are synchronously adjustable in a manner known per se such that during one full revolution of multi-eccentric shaft 1, each ring 7 comes alternately into contact with the inking roller 8 and the roller 9 for taking up the ink.

A pinion shaft 10 is mounted for rotation (FIG. 2) and extends in the cavity of hollow shaft 1 and has toothed portions 11 associated with at least each of eccentrics 6. Each eccentric 6 is provided with an internal gearing 12 meshing with a pinion 15 which is mounted for rotation on a bracket 14 secured in a recess 13 of multi-eccentric shaft 1. Pinion 15 cooperates and meshes with the respective associated toothed portion 11 of pinion shaft 10.

Multi-eccentric shaft 1 is driven through a gear 16 by the drive of the inking mechanism, while pinion shaft 10 is driven through a gear 17 in another sequence relative to the drive of the inking mechanism, namely in a way such that each eccentric 6 rotates equally rapidly back and forth relative to shaft 1, with other integral ratios of rotation also being possible.

During assemblage, the internal gear of each eccentric 6 is so adjusted relative to shaft 1 that the eccentricity of eccentric 6 reduces the effect of that of the associated portion of shaft 1 on the axis of rotation of ring 7 on the rotational connecting line of the axes of rotaton of shaft 1 and inking roller 8 by a maximum, with the assumption that the eccentricity of eccentric 6 is smaller than the eccentricities of shaft 1.

Figures 4, 5:
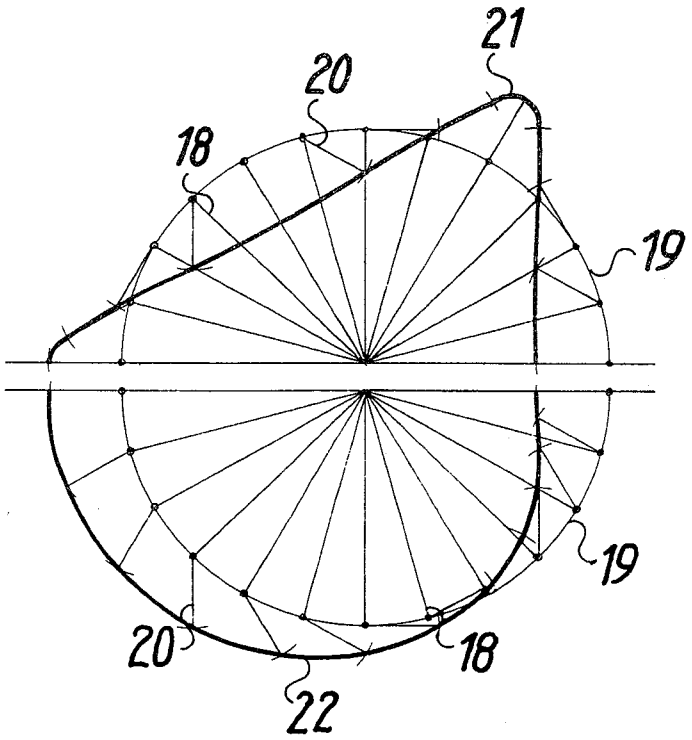
FIG. 4 is a greatly enlarged diagram indicating the path followed by the center of a ring during a rotation through 180° of the multi-eccentric shaft, with an oppositely rotated eccentric.
FIG. 5 shows the same path with an eccentric rotated in the same direction.

In FIGS. 4 and 5, which are on a far larger scale, lines 18 represent the eccentricity of the individual eccentric portions of shaft 1, with the center of the eccentric portion describing a circle 19 during one revolution of shaft 1 about the axis of rotation thereof.

Lines 20 represent the smaller eccentricity of an eccentric 6.

If now eccentric 6 turns in the opposite direction relative to shaft 1, the center of ring 7 moves on a path corresponding to curve 21 of FIG. 4. If, on the contrary, eccentric 6 turns in the same direction as shaft 1, the center of ring 7 describes a path corresponding to curve 22 of FIG. 5.

In both instances, while designing such a spiral-type ductor, the ratio of the two eccentricities and the speed ratio may be so optimized that in the zone of contact between ring 7 and inking roller 8, curves 21 and 22 extend in a manner such that the contact takes place within an angle of rotation up to 150° of shaft 1, with the possibility at the same time of utilizing a deformation of the elastic surface of rings 7 of the order of magnitude of 0.3 mm.

Figure 3:
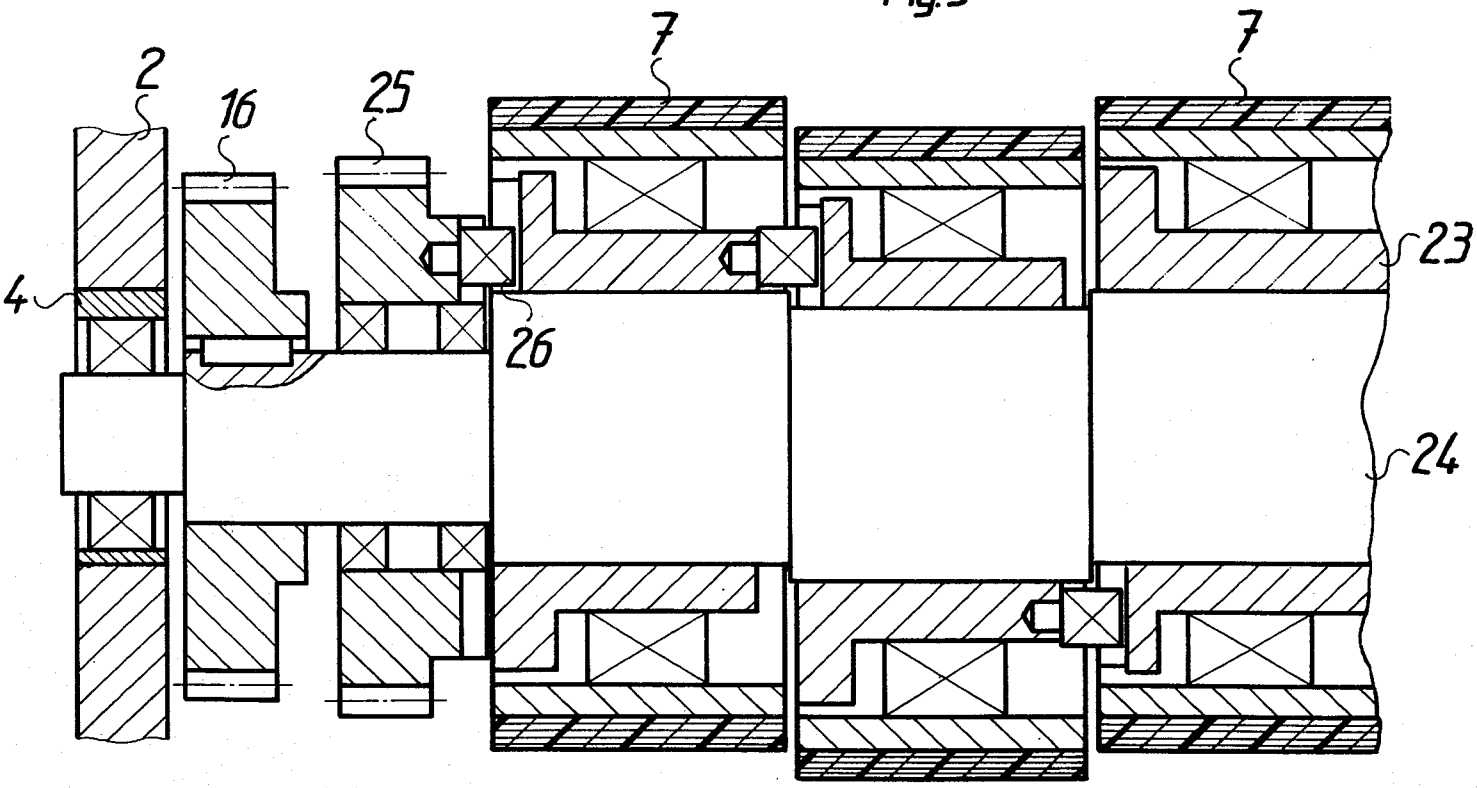
FIG. 3 is a similar view of an embodiment in which the eccentrics are coupled to a drive wheel.

FIG. 3 shows an embodiment of the inventive ductor in which eccentrics 23 are all connected to each other and to a drive gear 25 which is mounted for free rotation on multi-eccentric shaft 24, by means of radially sliding dogs 26 which ride in radial grooves defined in each eccentric 23.

While specific embodiments of the invention have been shown and described in detail to illustrate the application of the principles of the invention, it will be understood that the invention may be embodied otherwise without departing from such principles.

What is claimed is:

1. A spiral-type ductor adapted for transferring ink from a fountain roller to a roller for taking up ink of an inking system of a rotary printing press comprising a multi-eccentric shaft having a plurality of eccentric portions disposed in angularly offset relationship therealong, an eccentric rotatably journaled on each of said plurality of eccentric portions of said multi-eccentric shaft, said eccentrics being disposed in angularly offset arrangement relative to one another on said multi-eccentric shaft, a ring mounted for rotation on each of said eccentrics so that said rings successively and alternately are adapted to come into contact with a fountain roller and an ink take-up roller along a path defining a spiral, a first drive means connected to said eccentrics for effecting the drive thereof, and a second drive connected to said multi-eccentric shaft to effect the drive thereof, whereby the eccentricity of each of said rings is the summation of the eccentricity of said eccentric portion and its corresponding eccentric.

2. The invention as defined in claim 1 wherein said multi-eccentric shaft is hollow, and said first drive means comprises a pinion shaft extending axially within said hollow multi-eccentric shaft, each of said eccentric having an internal gearing portion, and means interconnecting said pinion shaft in driving relationship with each of said internal gearing portions of said respective eccentrics for effecting the drive thereof.

3. The invention as defined in claim 1 and including means for interconnecting said eccentrics to each other, whereby said eccentrics can be rotated as a unit, and said first drive means comprises a drive wheel connected to one of said eccentrics to effect the drive thereof.

4. The invention as defined in claim 1 and including an eccentric bushing forming the end supports for said multi-eccentric shaft; and said first and second drive means being independently driven.

* * * * *